US011739496B2

(12) United States Patent
Smith et al.

(10) Patent No.: US 11,739,496 B2
(45) Date of Patent: Aug. 29, 2023

(54) WORKING MACHINE

(71) Applicant: J.C. BAMFORD EXCAVATORS LIMITED, Uttoxeter (GB)

(72) Inventors: Duncan Andrew Smith, Uttoxeter (GB); Patrick Edward Naylor, Uttoxeter (GB)

(73) Assignee: J.C. BAMFORD EXCAVATORS LIMITED, Uttoxeter (GB)

( * ) Notice: Subject to any disclaimer, the term of this patent is extended or adjusted under 35 U.S.C. 154(b) by 384 days.

(21) Appl. No.: 17/026,102

(22) Filed: Sep. 18, 2020

(65) Prior Publication Data

US 2021/0087785 A1 Mar. 25, 2021

(30) Foreign Application Priority Data

Sep. 19, 2019 (GB) ..... 1913550

(51) Int. Cl.
*E02F 3/96* (2006.01)
*E02F 3/36* (2006.01)
(Continued)

(52) U.S. Cl.
CPC ..... *E02F 3/964* (2013.01); *E02F 3/3663* (2013.01); *E02F 9/02* (2013.01); *E02F 9/166* (2013.01);
(Continued)

(58) Field of Classification Search
CPC ... E02F 3/301; E02F 3/964; E02F 3/32; E02F 3/325; E02F 3/28
See application file for complete search history.

(56) References Cited

U.S. PATENT DOCUMENTS 5,251,440 A * 10/1993 Bong-dong ..... E02F 9/2292 60/431
2012/0233991 A1* 9/2012 Ivantysynova ..... F15B 11/17 60/413

FOREIGN PATENT DOCUMENTS

EP 2189578 A1 5/2010
GB 2433551 A 6/2007
(Continued)

OTHER PUBLICATIONS

Search Report for GB 1913550.8, dated Jun. 17, 2020.

*Primary Examiner* — Abiy Teka
(74) *Attorney, Agent, or Firm* — MARSHALL, GERSTEIN & BORUN LLP

(57) ABSTRACT

A working machine includes a ground engaging structure, and an undercarriage supported on the ground engaging structure. The undercarriage has a drive arrangement for moving the ground engaging structure to propel the working machine, the drive arrangement comprising a prime mover and a transmission comprising a hydraulic pump arrangement configured to be driven by the prime mover. A superstructure rotatably mounted to the undercarriage and a working arm is connected to the superstructure. A first implement mount connected the undercarriage for operably mounting a working implement to the undercarriage. The undercarriage has a first actuator for raising and lowering a working implement when mounted to the first implement mount and comprises a hydraulic connector for supplying hydraulic fluid to the first actuator to actuate the first actuator, and a first auxiliary hydraulic connector is provided that is configured for supplying hydraulic fluid to an implement connected thereto.

18 Claims, 3 Drawing Sheets

(51) Int. Cl.

| | |
|---|---|
| ***E02F 9/02*** | (2006.01) |
| ***E02F 9/16*** | (2006.01) |
| ***E02F 9/18*** | (2006.01) |
| ***E02F 9/22*** | (2006.01) |
| *E02F 3/32* | (2006.01) |
| *E02F 3/76* | (2006.01) |
| *E02F 9/08* | (2006.01) |

(52) U.S. Cl.
CPC ..... *E02F 9/18* (2013.01); *E02F 9/2228* (2013.01); *E02F 9/2235* (2013.01); *E02F 9/2292* (2013.01); *E02F 9/2296* (2013.01); *E02F 3/32* (2013.01); *E02F 3/7604* (2013.01); *E02F 9/085* (2013.01)

(56) References Cited

FOREIGN PATENT DOCUMENTS

| | | | | |
|---|---|---|---|---|
| WO | WO-2011/152709 | A2 | 12/2011 | |
| WO | WO-2017/101942 | A1 | 6/2017 | |
| WO | WO-2017101942 | A1 * | 6/2017 | ..... B62D 21/186 |

* cited by examiner

WORKING MACHINE

FIELD OF THE INVENTION

The present invention relates to a working machine.

BACKGROUND OF THE INVENTION

Various types of working machines are known such as excavators (e.g. slew excavators), telehandlers and backhoe loaders. Such machines may typically be used for soil-shifting operations (e.g. trenching, grading, and loading) and materials handling (e.g. depositing aggregate in trenches, lifting materials and placing them on an elevated platform).

Slew excavators comprise a superstructure rotatable in an unlimited fashion relative to an undercarriage. The superstructure includes a working arm arrangement for manipulating an attachment, such as a bucket, to perform working operations of the type listed above, a prime mover, such as a diesel IC engine, a hydraulic pump, and an operator cab. The prime mover drives a hydraulic pump, in order to provide pressurized fluid to operate the working arm arrangement, to power one or more hydraulic motors to selectively drive either two endless tracks or four wheels (or eight wheels in a dual wheel configuration) for propelling the excavator.

A slew ring rotatably connects the superstructure and undercarriage, and a central rotary joint arrangement enables hydraulic fluid to pass from the pump in the superstructure to the hydraulic motor, and return to the superstructure, irrespective of the relative positions of the superstructure and undercarriage.

In order to increase the functionality of working machines, a wide variety of working implements may be attached thereto. When connected to the machine, these working implements are actuated via auxiliary hydraulic fluid lines, driven by a hydraulic pump. However, routing of the hydraulic fluid lines can also to lead to excessive heat generation in the working machine.

The present invention seeks to overcome or at least mitigate one or more problems associated with the prior art.

SUMMARY OF THE INVENTION

A first aspect of the invention provides a working machine comprising: a ground engaging structure provided in the form of front and rear wheels or a pair of endless tracks; an undercarriage supported on the ground engaging structure, the undercarriage comprising a drive arrangement for moving the ground engaging structure to propel the working machine, the drive arrangement comprising a prime mover and a transmission comprising a hydraulic pump arrangement configured to be driven by the prime mover; a superstructure rotatably mounted to the undercarriage; a working arm connected to the superstructure; and a first implement mount connected the undercarriage for operably mounting a working implement to the undercarriage, wherein the undercarriage comprises a first actuator for raising and lowering a working implement when mounted to the first implement mount and comprises a hydraulic connector for supplying hydraulic fluid to the first actuator to actuate the first actuator, and wherein the undercarriage comprises a first auxiliary hydraulic connector configured for supplying hydraulic fluid to an implement connected thereto.

Typically, for slewing excavators, auxiliary hydraulic connection points are provided on the working arm. In order to use auxiliary components/implements, a user would first be required to remove the bucket from the working arm before connecting the addition implement. Through the present arrangement, the slewing excavator is able to connect auxiliary implements to the undercarriage which are able to be used without requiring the bucket to be removed (thus enabling them to be used in combination).

The auxiliary hydraulic enables hydraulic fluid to be supplied to an implement to actuate a further function of said implement (in addition to raising/lowering the implement via actuators), or to an additional implement to those mounted to the implement mounts.

Additionally, providing the drive arrangement and the auxiliary connections in the undercarriage removes the need to direct the hydraulic fluid through a rotary connection between the undercarriage and superstructure and provides a more compact auxiliary hydraulic arrangement. This arrangement reduces heat in the hydraulic flow path as the flow through the connection between undercarriage and superstructure is reduced.

In one embodiment, the first implement mount comprises a standardized interface configuration.

Advantageously, this enables a wide range of auxiliary implements to be connected to the undercarriage and to have hydraulic fluid provided via the first auxiliary hydraulic connection.

In one embodiment the first implement mount comprises a skid-steer loader implement interface configuration.

This arrangement significantly improves the functionality of the slewing excavator.

In one embodiment the first auxiliary hydraulic connector is provided one the same side of the undercarriage as the first implement mount.

This significantly shortens the hydraulic flow path, thus simplifying the hydraulic flow arrangement for mounting auxiliary components.

In one embodiment the undercarriage comprises a first control valve fluidly coupled to the hydraulic pump arrangement to regulate the supply of hydraulic fluid to the first hydraulic auxiliary connector.

This arrangement provides a compact arrangement of the auxiliary hydraulic control valve and the prime mover/hydraulic pump. This provides for a shorter hydraulic flow path with fewer connection interfaces, thus reducing the potential for the occurrence of leakages. Moreover, the close proximity of the hydraulic pump and auxiliary connections improves the efficiency of the auxiliary hydraulic system.

In one embodiment the hydraulic pump arrangement comprises a first hydraulic pump for moving the ground engaging structure to propel the working machine and a second hydraulic pump configured for supplying hydraulic fluid to the hydraulic connector and first auxiliary hydraulic connector.

In one embodiment the second hydraulic pump is configured for supplying hydraulic fluid to the working arm.

In one embodiment the first and second hydraulic pumps are driven by the prime mover via a common drive shaft.

In one embodiment the drive to the first and second pumps is in series.

In one embodiment the first hydraulic pump and/or second hydraulic pump comprises a variable displacement hydraulic transmission pump.

In one embodiment the working machine further comprises a second implement mount connected to an opposing side of the undercarriage as the first implement mount for operably mounting a working implement to the undercarriage, wherein the undercarriage comprises a second actuator for raising and lowering a working implement when mounted to the second implement mount and comprises a hydraulic connector for supplying hydraulic fluid to the second actuator to actuate the second actuator.

In one embodiment the undercarriage comprises a second auxiliary hydraulic connector configured for supplying hydraulic fluid to an implement connected thereto.

In one embodiment the second auxiliary hydraulic connector is provided one the same side of the undercarriage as the second implement mount.

In one embodiment the superstructure comprises an auxiliary hydraulic connector configured to supply hydraulic fluid to a working implement when connected thereto.

Advantageously, this arrangement improves the functionality of the machine by enabling the auxiliary implements to be connected to both the undercarriage and the superstructure.

In one embodiment the second auxiliary connector is provided on the working arm, and wherein the working arm comprises an arm implement mount at a distal end thereof for operably mounting a working implement to the working arm, and wherein the second auxiliary hydraulic connector is configured for supplying hydraulic fluid to a working implement mounted on the arm implement mount.

Advantageously, this arrangement improves the functionality of the machine by enabling the superstructure auxiliary implement to be used in combination with the undercarriage auxiliary implement(s). This also enables functions of implements connected to the working arm to actuated In one embodiment the working machine further comprises a control system configured to control operation of the one or more auxiliary hydraulic connectors such that the one or more auxiliary hydraulic connectors are able to be operated independently or at the same time.

In one embodiment the hydraulic pump arrangement comprises a variable displacement pump, and wherein the control system is configured to vary displacement of the variable displacement pump to supply hydraulic fluid to the one or more auxiliary hydraulic connectors.

In one embodiment displacement of the hydraulic pump arrangement is set to a first displacement value to provide hydraulic fluid to the first auxiliary connection point, and wherein displacement of the hydraulic pump arrangement is set to a second displacement value to supply hydraulic fluid to the first and second auxiliary hydraulic connection points, wherein the second displacement value is greater than the first displacement value.

In one embodiment the superstructure is mounted to the undercarriage via a rotary connection configured to permit hydraulic fluid to be routed to the second auxiliary hydraulic connection point independently of the position of the superstructure relative to the undercarriage.

In one embodiment the working machine comprises an operator's cab rotatably mounted on the superstructure, preferably rotatable by a rotary connection, wherein the superstructure is rotatable about a first generally upright axis and the operator's cab is rotatable about a second generally upright axis.

Advantageously, the cab and superstructure of the present invention can be rotated relative to each other for optimized working in confined working spaces and improved visibility. For example, when the working machine is driven on the road, the cab and superstructure can be rotated relative to each other so as to position the working arm to the rear of the working machine to give an operator an improved view of the road ahead.

In one embodiment the cab is offset from the center of the superstructure.

In one embodiment an entirety of the drive arrangement is positioned below a level coincident with a lower extent of the superstructure.

In one embodiment the prime mover is mounted in a transverse direction, e.g. perpendicular, to a fore-aft direction of the working machine.

In one embodiment the working arm is hydraulically actuated and a control valve is provided in the superstructure for controlling fluid flow to the working arm.

In one embodiment the working machine comprises a counterweight provided on the superstructure, the counterweight having a mass for counterbalancing the working arm, optionally wherein the counterweight is formed as a single unitary component, for example a cast iron or steel component.

BRIEF DESCRIPTION OF THE DRAWINGS

Embodiments of the invention will now be described with reference to the accompanying drawings, in which.

DETAILED DESCRIPTION OF EMBODIMENT(S)

Figure 1:
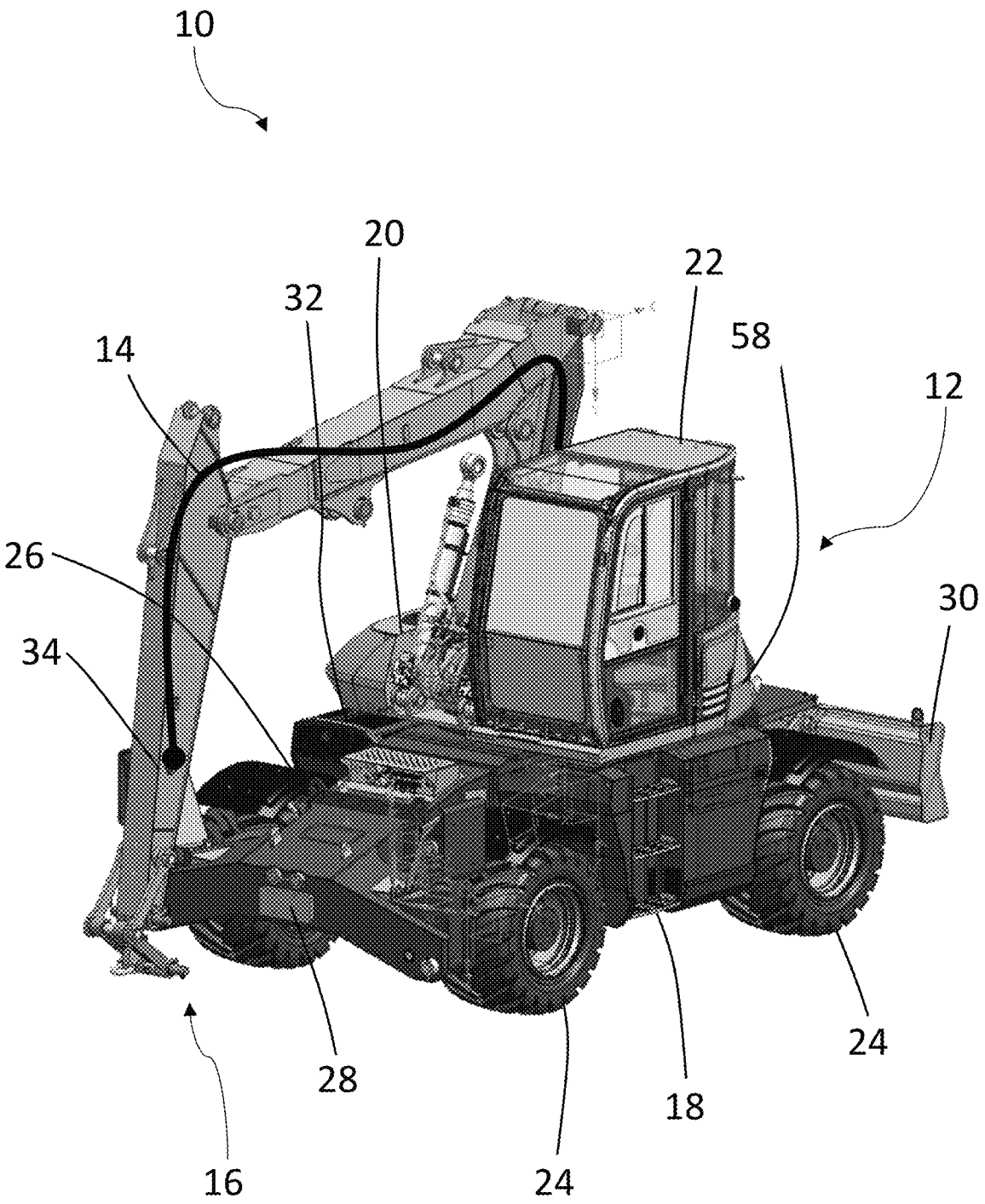
FIG. 1 is an isometric view of a working machine according to an embodiment.

Referring firstly to FIG. 1, a working machine is illustrated and is indicated generally at 10. In the present embodiment, the working machine 10 may be considered to be an excavator having an operating weight of approximately 20 metric tons, e.g. between 15 and 25 metric tons.

The working machine 10 includes a body 12 and a working arm 14 connected to the body 12. The working arm is connected to a superstructure 18 of the working machine 10. The working arm 14 is provided on the working machine 10 for carrying out working operations and includes an arm implement mount 16 at the distal end thereof. The arm implement mount 16 is provided for mounting an arm implement, e.g. a bucket, to the working arm 14.

The working machine 10 includes an undercarriage 18 and a superstructure 20. In the arrangement shown, the superstructure 20 is rotatably mounted on the undercarriage 18 via a rotary connection, for example via a slew ring. The rotary connection permits unrestricted rotation of the superstructure 20 relative to the undercarriage 18 in this embodiment. A cab 22 from which an operator can operate the working machine 10 is provided on the superstructure 20.

The working machine 10 includes a ground engaging structure 24 for supporting the undercarriage 18. The ground engaging structure 24 is provided in the form of front and rear wheels. In the embodiment, the ground engaging structure 24 includes first and second drive axles 46 mounted to the undercarriage 18 and wheels rotatably attached to each axle end. In this embodiment, the wheelbase is approximately 2.7 m, and a typical range may be in the range of 2.0 m to 3.5 m. It will be appreciated that in alternative arrangements, the ground engaging structure may be provided in the form of a pair of endless tracks.

The drive arrangement is provided on (i.e. housed within) the undercarriage 18 of the working machine 10. The drive arrangement is configured for driving the ground engaging structure 24 in order to propel the working machine 10.

In this embodiment, a stabilizer leg arrangement 28 is pivotally mounted to a first end, or front, of the undercarriage 18. The stabilizer leg arrangement may be raised and lowered by hydraulic cylinders (not shown) using a known arrangement.

A dozer blade arrangement 30 is pivotally secured to a second end, or rear, of the undercarriage 18. The dozer blade arrangement 30 may be raised and lowered by hydraulic cylinders (not shown) using a known arrangement. The dozer blade 30 may also act as a stabilizer for the working machine 10, by lifting the adjacent wheels off the ground when excavating.

The stabilizer leg arrangement 28 and the dozer blade 30 are operably mounted to the undercarriage 18 via implement mounts 26 provided at the first and second ends of the undercarriage 18. It will be appreciated that in some alternative arrangements, the stabilizer leg arrangement 28 and/or the dozer blade 30 may be omitted or may be replaced with a different working implement, such as a patch planer, a power brush, a rotary mower brush cutter, or a three point link for agricultural attachments.

In the illustrated embodiment, the stabilizer leg arrangement 28 is attached to a first implement mount 26 at the front of the working machine 10. The first implement mount 26 is provided in the form of a surface on the undercarriage 18 suitable for welding the stabilizer leg arrangement 28 to the undercarriage 18. The undercarriage 18 is provided with a hydraulic connector (not shown) for supplying hydraulic fluid to a actuators for actuating the working implement attached to the first implement mount 26, e.g. for raising/lowering the stabilizer legs.

The dozer blade 30 is attached to a second implement mount 27 at the rear of the working machine 10. Although not illustrated, the dozer blade 30 is connected to the undercarriage 18 by a pair of connecting arms. The connecting arms are configured to be driven by an actuator (not shown), e.g. for raising and lowering the dozer blade 30 relative to the undercarriage 18. The undercarriage 18 is provided with a hydraulic connector (not shown) for supplying hydraulic fluid to the actuator to raise/lower a working implement, e.g. the dozer blade 30, attached to the first implement mount 26.

In order to improve the functionality of the working machine 10, the undercarriage 18 is provided with a first auxiliary hydraulic connector 32 for connecting auxiliary working implements thereto. The first auxiliary hydraulic connector 32 is configured to supply hydraulic fluid to an implement attached to the first implement mount 26 to actuate a further function of the implement (i.e. in addition to raising/lowering via actuators) or to provide hydraulic fluid to an additional working implement.

The first auxiliary hydraulic connector 32 is provided one the same side of the undercarriage 18 as the first implement mount 26. This significantly shortens the hydraulic flow path, thus simplifying the hydraulic flow arrangement for mounting implements to the undercarriage 18.

Through incorporation auxiliary hydraulic connector 32, the slewing excavator is able to connect implements to the undercarriage (i.e. without requiring the bucket to be removed from the working arm to attach an implement thereto). This enables the working arm and implements to be used in combination.

Although not shown in FIG. 1, the working machine 10 further includes a second auxiliary hydraulic connector 33 for connecting auxiliary working implements thereto. The second auxiliary hydraulic connector 33 is configured to supply hydraulic fluid to an implement attached to the second implement mount 27 to actuate a further function of the implement (i.e. in addition to raising/lowering via actuators) or to provide hydraulic fluid to an additional auxiliary working implement.

The second auxiliary hydraulic connector 33 is provided one the same side of the undercarriage 18 as the second implement mount 27. This significantly shortens the hydraulic flow path, thus simplifying the hydraulic flow arrangement for mounting auxiliary implements.

The working machine 10 includes auxiliary hydraulic connectors 32, 33 at both the front at the rear of the undercarriage 18. Each of the auxiliary hydraulic connectors 32 is configured for actuating an additional function of a working implement mounted on the respective implement mount, or to actuator an additional implement. Providing the auxiliary hydraulic connectors 32, 33 and the drive arrangement in the undercarriage 18 reduces hydraulic flow between the undercarriage 18 and superstructure 20 (i.e. through the rotary connection), which reduces heat generated at the rotary connection.

Although not illustrated, each auxiliary implement mount 26 may be provided in the form of an implement coupler that is connected to the undercarriage by one or more connecting arms. Each hydraulic connector may be configured for supplying hydraulic fluid to actuators to raise/lower the implement coupler so as to raise/lower a working implement attached thereto.

As discussed above, the superstructure 20 is rotatably mounted on the undercarriage 18 via a rotary connection.

The superstructure 14 comprises a rotating platform 26 mounted on the slew ring. The slew ring is substantially central to the undercarriage 18 in a fore-aft direction and a lateral direction L, so as to mount the superstructure 20 substantially centrally to the undercarriage 18. The slew ring permits rotation of the superstructure 20 relative to the undercarriage 18 about a generally upright axis. The rotary connection is configured to permit hydraulic fluid to be routed from the undercarriage 18 to the superstructure 20 independently of the position of the superstructure 20 relative to the undercarriage 18.

The platform 26 mounts a cab 22. The cab 22 is offset to one side of the undercarriage 18 in a lateral direction. The cab 22 houses the operator's seat and machine controls. The cab 22 is mounted to the platform via a rotary joint arrangement. Rotation of the cab 22 relative to the superstructure 20 is limited to 270° in this embodiment, but may be in a range of 180° to 360° in alternative arrangements. Put another way, the superstructure 20 is rotatable about a first generally upright axis and the cab 22 is rotatably mounted on the superstructure 20 so as to be rotatable about a second generally upright axis, different to the first axis.

The superstructure 20 includes a counterweight 58 for counterbalancing the working arm 14. The counterweight 58 is positioned at an opposite side of the superstructure 20 to the working arm 14. As is illustrated, the counterweight 58 is positioned behind the cab, and is arranged so as to abut against the cab 22.

The superstructure 20 may also include an auxiliary hydraulic connector 34 configured to supply hydraulic fluid to a working implement attach thereto. In the illustrated arrangement, the second auxiliary hydraulic connector 34 is provided on the working arm 14, and is configured for supplying hydraulic fluid to a working implement attached to the arm implement mount 16.

The working machine is provided with a control system (not shown) configured to control operation of the auxiliary hydraulic connectors 32, 33, 34. The control system enables hydraulic fluid to be directed to one or more of the auxiliary hydraulic connectors 32, 33, 34 such that they are able to be operated independently or at the same time.

Figure 2:
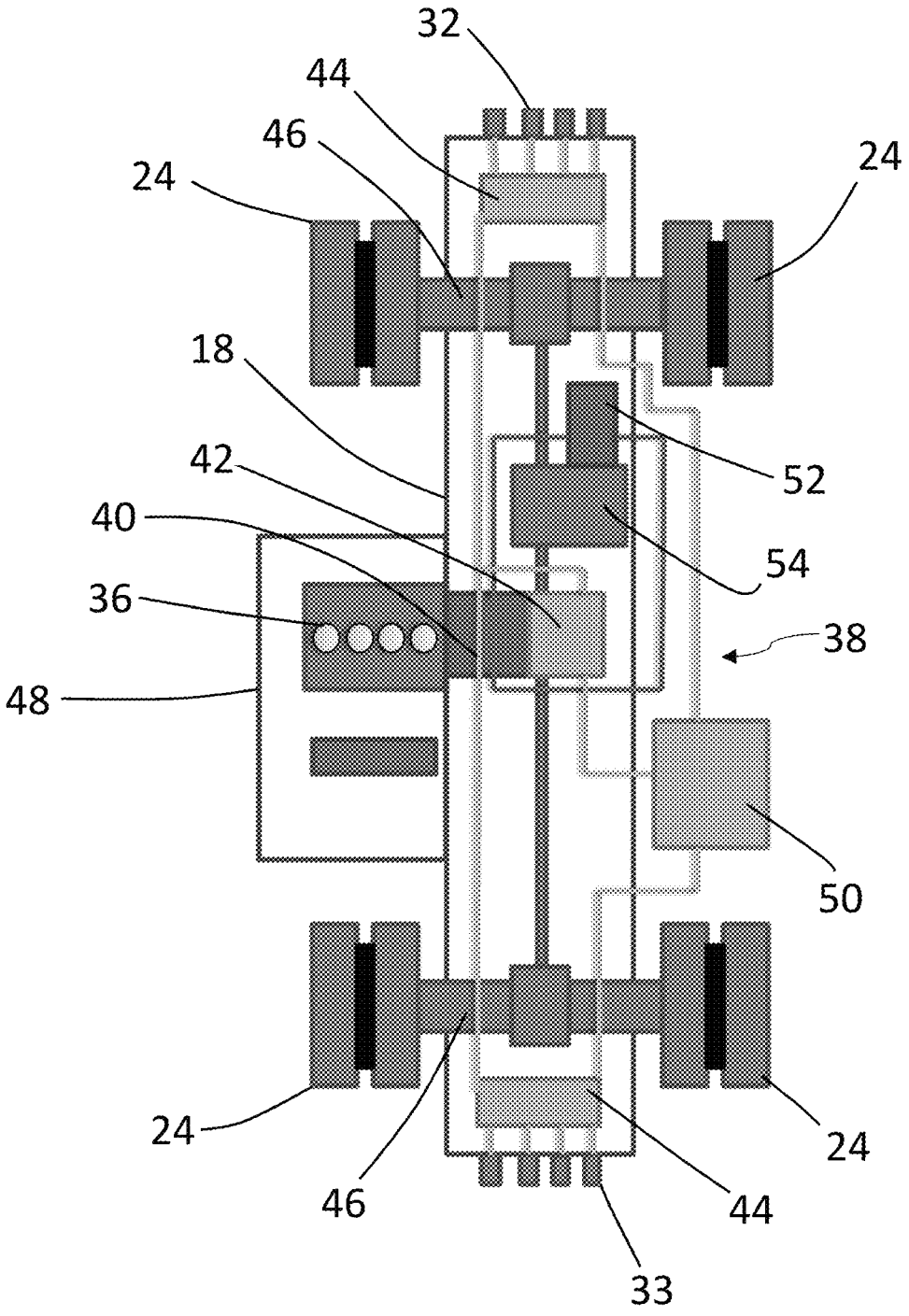
FIG. 2 is a schematic view of the undercarriage of the working machine of FIG. 1.

Referring to FIG. 2, the hydraulic layout of the undercarriage 18 of the working machine 10 is shown in somewhat simplified form.

As discussed above, the working machine 10 includes a drive arrangement for driving the ground engaging structure 24 via front and rear axles 46 in order to propel the working machine 10. The drive arrangement includes a prime mover 36 and a hydraulic pump arrangement 38 configured to be driven by the prime mover 36. The hydraulic pump arrangement 38 is rotationally coupled to the prime mover 36 to generate a flow of hydraulic fluid. The prime mover 36 is housed within a side pod 48 that is positioned on an opposing side of the undercarriage 18 to a hydraulic fuel tank 50.

For the purposes of the present application, the fore-aft direction is defined as a direction substantially parallel to the general direction between the front and rear (i.e. the first and second ends) of the undercarriage 18.

In the present embodiment, the prime mover is a diesel IC engine 36. The engine 36 is mounted to one side. The engine 36 is mounted transverse to a fore-aft axis of the undercarriage 18. The engine 36 is further orientated such that the pistons of the engine 36 extend in the substantially upright direction. An entirety of the drive arrangement is positioned below a level coincident with a lower extent of the superstructure 20. The drive arrangement may also include a heat exchanger and cooling fan (not shown) housed in the undercarriage 18 adjacent the engine 36.

In the present embodiment the transmission is a hydrostatic transmission. The transmission (i.e. the hydraulic pump arrangement 38) includes a first hydraulic pump 40 for moving the ground engaging structure 24 to propel the working machine 10. The first hydraulic pump 40 is configured to be charged with hydraulic fluid via a charge pump (not shown) which is also mounted in series to the prime mover 36. The charge pump is supplied with hydraulic fluid from the hydraulic fluid tank 50. The first hydraulic pump 40 supplies hydraulic fluid to first and second hydraulic motors (not shown) in order to drive the respective axle 46. The hydraulic motor 52 drives the front and rear axles 46 via a gearbox 54. In other embodiments a single hydraulic motor may provide drive to both the front and rear axles.

The hydraulic pump arrangement 38 includes a second hydraulic pump 42 configured for supplying hydraulic fluid for control the working arm 14. The second hydraulic pump 42 is configured for supplying hydraulic fluid to the auxiliary hydraulic connectors 32, 33, 34 in order to actuate one or more working implements attached to the working machine 10.

The engine 36 is configured to drive the first and second hydraulic pumps 40, 42. The pumps 40, 42 are configured to draw hydraulic fluid from the hydraulic fluid tank 50 as required. The flow is essentially closed loop but with hydraulic fluid drawn from and returned from the tank 50 as required. The first and second hydraulic pumps 40, 42 are connected to the prime mover 36 via a common drive shaft (not shown) driven by the prime mover. Put another way, the first and second hydraulic pumps 40, 42 are connected to the prime mover in series. In alternative arrangements, the first and second hydraulic pumps 40, 42 may be connected to the prime mover 36 in parallel or radially.

The first and second hydraulic pumps 40, 42 are provided in the form of variable displacement hydraulic transmission pumps, e.g. swash plate type pumps. It will be appreciated that in alternative arrangements different hydraulic pumps may be used, such as gear pumps or piston pumps.

The first hydraulic pump 40 is configured to be charged with hydraulic fluid via a charge pump (not shown) which is also mounted in series, which is supplied with hydraulic fluid from the hydraulic fluid tank 50.

The control system is configured to vary displacement of the second hydraulic pump 42 to vary the volume of hydraulic fluid delivered to the first and/or second auxiliary hydraulic connectors 32, 34, as required. Displacement of the second hydraulic pump 42 may be set to a first displacement value to provide hydraulic fluid to the first auxiliary connector 32. Displacement of the second hydraulic pump 42 may be set to a second, larger, displacement value to supply hydraulic fluid to both the first and second auxiliary hydraulic connection points 32, 34.

The undercarriage 18 includes a control valve 44 fluidly coupled to the hydraulic pump arrangement to regulate the supply of hydraulic fluid to the first hydraulic auxiliary connector 32. It will be appreciated that both hydraulic auxiliary connectors 32, 33 are provided with a respective control valve to regulate the supply of hydraulic fluid. This arrangement positions the control valve proximate to the auxiliary connectors in the undercarriage, to produce a compact auxiliary hydraulic arrangement.

Figure 3:
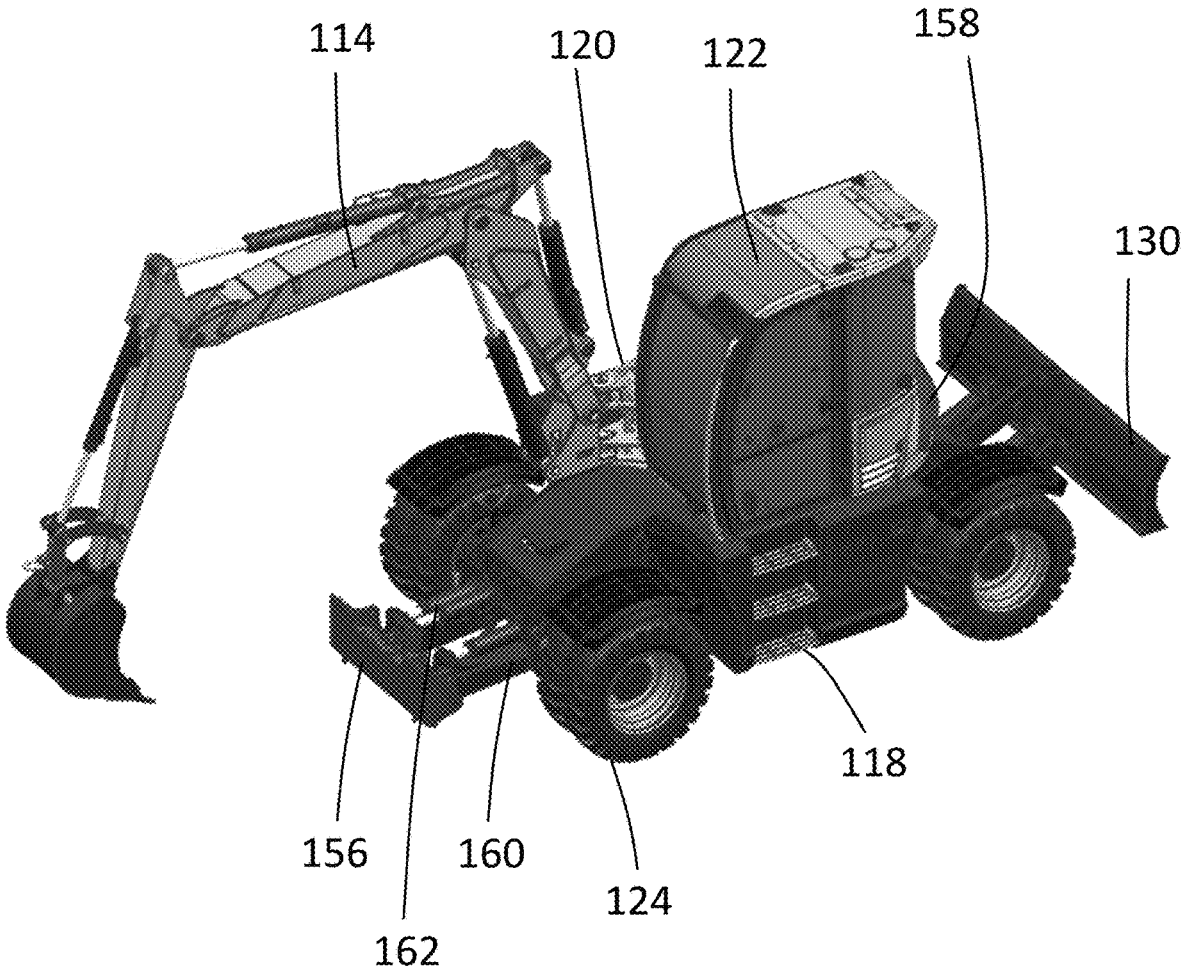
FIG. 3 is an isometric view of a working machine according to an embodiment.

Referring now to FIG. 3, a working machine is illustrated and is indicated generally at 100. Corresponding components of this figure with FIG. 1 are labelled with the prefix '1' and only differences are discussed in more detail.

Similar to the working machine of FIG. 1, the working machine 100 includes a dozer blade 130 attached to a second implement mount 127 at the rear of the working machine 110.

At the opposing, i.e. front, end of the undercarriage 118, the working machine includes an implement mount 156 for mounting working implements thereto.

The implement mount 156 is provided in the form of an implement coupler that is connected to the undercarriage 118 by one or more connecting arms 160.

One or more actuators 162 are provided between the implement mount 156 and the undercarriage 118. The undercarriage is provided with hydraulic connectors (not shown) for supplying hydraulic fluid to the actuators 162 such that the implement mount can be raised/lowered relative to the undercarriage 118. Although not illustrated, a further actuator may be provided between the implement mount 156 and the undercarriage 118 so as to be capable of tilting the implement mount 156.

The implement mount is provided with a standardized interface configuration to enable a range of auxiliary implements to be connected thereto. Put another way, the auxiliary implement mount 156 is provided with a skid-steer loader implement interface configuration. The auxiliary implement 156 is provided on the same side of the undercarriage 118 as the first auxiliary hydraulic connection point 132. This arrangement helps to improve the functionality of the working machine.

Providing an undercarriage 118 having a standardized interface configuration for connecting working implements thereto as well as having one or more auxiliary hydraulic connectors has been found to improve the versatility and functionality of the working machine 100. Although not illustrated, it will be appreciated that the undercarriage could be provided with an implement mount 156 having a standardized interface configuration at both the front and rear of the undercarriage 118.

Although the invention has been described above with reference to one or more preferred embodiments, it will be appreciated that various changes or modifications may be made without departing from the scope of the invention as defined in the appended claims.

The invention claimed is:

1. A working machine comprising:

a ground engaging structure provided in the form of front and rear wheels or a pair of endless tracks;

an undercarriage supported on the ground engaging structure, the undercarriage comprising a drive arrangement for moving the ground engaging structure to propel the working machine, the drive arrangement comprising a prime mover and a transmission comprising a hydraulic pump arrangement configured to be driven by the prime mover;

a superstructure rotatably mounted to the undercarriage;

a working arm connected to the superstructure; and a first implement mount connected the undercarriage for operably mounting a working implement to the undercarriage, wherein the undercarriage comprises a first actuator for raising and lowering the working implement when mounted to the first implement mount and comprises a hydraulic connector for supplying hydraulic fluid to the first actuator to actuate the first actuator, and wherein the undercarriage comprises a first auxiliary hydraulic connector configured for supplying hydraulic fluid to the working implement connected thereto;

further comprising a second implement mount connected to an opposing side of the undercarriage relative to the first implement mount for operably mounting the working implement or an alternative working implement to the undercarriage, wherein the undercarriage comprises a second actuator for raising and lowering the working implement connected thereto when mounted to the second implement mount and comprises a second hydraulic connector for supplying hydraulic fluid to the second actuator to actuate the second actuator; and wherein the undercarriage comprises a second auxiliary hydraulic connector configured for supplying hydraulic fluid to the working implement connected thereto, and wherein the second auxiliary hydraulic connector and the second implement mount are provided on the opposing side of the undercarriage.

2. A working machine according to claim 1, wherein the first implement mount comprises a standardized interface configuration.

3. A working machine of claim 2, wherein the first implement mount comprises a skid-steer loader implement interface configuration.

4. A working machine according to claim 1, wherein the first auxiliary hydraulic connector and the first implement mount are provided on the opposing side of the undercarriage.

5. A working machine according to claim 1, wherein the undercarriage comprises a first control valve fluidly coupled to the hydraulic pump arrangement to regulate the supply of hydraulic fluid to the first hydraulic auxiliary connector.

6. A working machine according to claim 1, wherein the hydraulic pump arrangement comprises a first hydraulic pump for moving the ground engaging structure to propel the working machine and a second hydraulic pump configured for supplying hydraulic fluid to the hydraulic connector and first auxiliary hydraulic connector.

7. A working machine according to claim 6, wherein the first and second hydraulic pumps are driven by the prime mover via a common drive shaft.

8. A working machine according to claim 6, wherein the first hydraulic pump and/or second hydraulic pump comprises a variable displacement hydraulic transmission pump.

9. A working machine according to claim 1, wherein the undercarriage comprises a second auxiliary hydraulic connector configured for supplying hydraulic fluid to an implement connected thereto.

10. A working machine according to claim 1, wherein the superstructure comprises an auxiliary hydraulic connector configured to supply hydraulic fluid to the working implement when connected thereto.

11. A working machine according to claim 10, wherein the auxiliary hydraulic connector of the superstructure is provided on the working arm, and wherein the working arm comprises an arm implement mount at a distal end thereof for operably mounting a working implement to the working arm, and wherein the second auxiliary hydraulic connector is configured for supplying hydraulic fluid to a working implement mounted on the arm implement mount.

12. A working machine according to claim 1, comprising a control system configured to control operation of the first and second auxiliary hydraulic connectors such that the first and second auxiliary hydraulic connectors are able to be operated independently or at the same time.

13. A working machine according to claim 12, wherein the hydraulic pump arrangement comprises a variable displacement pump, and wherein the control system is configured to vary displacement of the variable displacement pump to supply hydraulic fluid to the one or more auxiliary hydraulic connectors.

14. A working machine according to claim 13, wherein displacement of the hydraulic pump arrangement is set to a first displacement value to provide hydraulic fluid to the first auxiliary connection point, and wherein displacement of the hydraulic pump arrangement is set to a second displacement value to supply hydraulic fluid to the first and second auxiliary hydraulic connection points, wherein the second displacement value is greater than the first displacement value.

15. A working machine according to claim 1, comprising an operator's cab rotatably mounted on the superstructure, and rotatable by a rotary connection, wherein the superstructure is rotatable about a first generally upright axis and the operator's cab is rotatable about a second generally upright axis.

16. A working machine according to claim 1, wherein an entirety of the drive arrangement is positioned below a level coincident with a lower extent of the superstructure.

17. A working machine according to claim 1, wherein the working arm is hydraulically actuated and a control valve is provided in the superstructure for controlling fluid flow to the working arm.

18. A working machine according to claim 1, wherein the working machine comprises a counterweight provided on the superstructure, the counterweight having a mass for counterbalancing the working arm.

* * * * *